US005362339A

United States Patent [19]

Horimura et al.

[11] Patent Number: 5,362,339

[45] Date of Patent: Nov. 8, 1994

[54] MAGNETIC REFRIGERANT AND PROCESS FOR PRODUCING THE SAME

[75] Inventors: Hiroyuki Horimura, Saitama; Tsuyoshi Masumoto, Miyagi; Akihisa Inoue, Miyagi; Kazuhiko Kita, Miyagi; Hitoshi Yamaguchi, Tokyo, all of Japan

[73] Assignee: Honda Giken Kogyo Kabushiki Kaisha, Tokyo, Japan

[21] Appl. No.: 850,742

[22] Filed: Mar. 13, 1992

[30] Foreign Application Priority Data

Mar. 14, 1991 [JP] Japan ..... 3-74680

[51] Int. Cl.[5] ..... C22C 45/00

[52] U.S. Cl. ..... 148/403; 420/416

[58] Field of Search ..... 252/67; 148/403; 420/416

[56] References Cited

U.S. PATENT DOCUMENTS

| | | | |
|---|---|---|---|
| 4,849,017 | 7/1989 | Sahashi et al. | 75/245 |
| 5,060,478 | 10/1991 | Fukamichi | 148/403 |
| 5,074,935 | 12/1991 | Masumoto et al. | 148/403 |

FOREIGN PATENT DOCUMENTS

| | | |
|---|---|---|
| 0193743 | 9/1986 | European Pat. Off. . |
| 61-37945 | 2/1986 | Japan . |
| 62-30829 | 2/1987 | Japan . |
| 62-30840 | 2/1987 | Japan . |

OTHER PUBLICATIONS

Materials Transactions, Jim, vol. 31, No. 2, Feb. 1990 (Retitled from Transactions of the Japan Institute of Metals).

Materials Transactions, Jim, vol. 31, No. 5, May, 1990 (Retitled from Transactions of the Japan Institute of Metals).

*Primary Examiner*—George Wyszomierski

*Attorney, Agent, or Firm*—Lyon & Lyon

[57] ABSTRACT

A cast magnetic refrigerant having a composition represented by $$Ln_aA_bM_c$$

wherein Ln is at least one element selected from the group consisting of Ce, Pr, Nd, Sm, Eu, Gd, Tb, Dy, Ho, Er, Tm and Yb; A is any one of elements of Al and Ga; M is at least one element selected from the group consisting of Fe, Co, Ni, Cu and Ag; each of a, b and c is atomic %, with the proviso that $a+b+c=100$ atomic %, 20 atomic % $\leqq a \leqq 80$ atomic %, 5 atomic % $\leqq b \leqq 50$ atomic %, 5 atomic % $\leqq c \leqq 60$ atomic %, and having an amorphous structure with a difference $\Delta T$ of 10K or more between a glass transition temperature Tg and a crystallization temperature Tx.

1 Claim, 5 Drawing Sheets

MAGNETIC REFRIGERANT AND PROCESS FOR PRODUCING THE SAME

BACKGROUND OF THE INVENTION

1. Field of the Invention

This invention generally relates to a novel magnetic refrigerant or magnetic refrigeration working substance for use in magnetic refrigerator, and particularly, to a magnetic refrigerant having an amorphous structure and to processes for producing the same.

The magnetic refrigerator utilizes a magnetic calorie effect of the magnetic refrigerant and has an advantage of its high cooling capability per unit volume, as compared with a gas refrigerator and hence, it is used in the production of liquid helium.

Magnetic refrigeration is based on the principle of alternate repetition of two heat-exchange steps: a heat exhausting step of magnetizing the magnetic refrigerant, wherein heat generated thereby is released to the outside, and a heat absorbing step of abstracting heat from an object such as helium by the magnetic refrigerant cooled by adiabetic demagnetization. In the case of Ericsson cycle as a refrigeration cycle, a work W performed by a magnetic material is represented by $W=\Delta S_M(T_1-T_2)$, wherein $\Delta S_M$ is a magnetic entropy; $T_1$ is a high temperature in the cycle; and $T_2$ is a low temperature in the cycle. The magnetic refrigerant is required to have characteristic such as a large magnetization in the range of operation, a high coefficient of thermal conductivity in the range of operation, and be a large-sized block.

In general, the magnetic refrigerant is classified broadly into a type used in a range of low temperature of less than 20 K., and a type used in a range of high temperature of 20 K. or more. GGG ($Gd_3Ga_5O_{12}$) belongs to the former, and compounds containing a rare earth element or elements belong to the latter. The magnetic refrigerant according to the present invention belongs to the latter.

2. Description of the Prior Art

There is a conventioanlly known magnetic refrigerant having an amorphous structure and containing a rare earth element or elements, as disclosed in Japanese Laid-open Patent Application No. 37945/86. This magnetic refrigerant is produced by a melting process such as a single-roll process, or by a spattering process.

However, a ribbon produced by the melting process usually has a thickness of 10 to 40 μm and therefore, in order to produce a block larger in size than this ribbon, e.g., a thick plate, a large number of thin plates cut from a ribbon must be secondarily laminated and press-bonded to one another. However, the resulting thick plate has a problem in that each of the large number of thin plates contains an oxide film on their surface. Hence, the thick plate has a low coefficient of thermal conductivity, resulting in a reduced cooling efficiency.

SUMMARY OF THE INVENTION

It is an object of the present invention to provide a magnetic refrigerant which is capable of being primarily formed into a large-sized block and secondarily formed into a further large-sized block and which has a high coeficient of thermal conductivity.

It is another object of the present invention to provide a magnetic refrigerant which has an excellent toughness and an excellent resistance to oxidation and whose electric resistance can be increased to reduce a power loss due to an eddy current.

It is a further object of the present invention to provide a magnetic refrigerant producing process, wherein a magnetic refrigerant which is a large-sized block and has an amorphous structure can be cast by use of a rotary metal mold.

It is a yet further object of the present invention to provide a magnetic refrigerant producing process, wherein a magnetic refrigerant can be produced to have a desired shape by a plastic working.

To achieve the above objects, according to the present invention, there is provided a magnetic refrigerant, which has a composition represented by $$Ln_aA_bM_c$$

wherein Ln is at least one element selected from the group consisting of Ce, Pt, Nd, Sm, Eu, Gd, Tb, Dy, Ho, Er, Tm and Yb; A is any one of elements of Al and Ga; M is at least one element selected from the group consisting of Fe, Co, Ni, Cu and Ag; each of a, b and c is an atomic %; with the proviso that $a+b+c=100$ atomic %, 20 atomic % $\leqq a \leqq 80$ atomic %; 5 atomic % $\leqq b \leqq 50$ atomic %; 5 atomic % $\leqq c \leqq 60$ atomic % and which has an amorphous structure with a difference $\Delta T$ of 10 K. or more between a glass transition temperature Tg and a crystallization temperature Tx, with the proviso that $Tx>Tg$.

The magnetic refrigerant used in the range of high temperature utilizes an internal magnetization by a ferromagnetic interaction. Therefore, in order to enlarge the range of cooling temperature as wide as possible, it is required that the effective magnetic moment is large in a wide range of temperature, and that the Curie point can be arbitrarily be selected.

In the above-described composition, Ce, Pr, Nd, Sm, Eu, Gd, Tb, Dy, Ho, Er, Tm and Yb (Ln, rare earth element) are essential as an element for magnetization. If the content a thereof is less than 20 atomic % ($a<20$ atomic %), the magnetization is small. On the other hand, if the content a thereof is more than 80 atomic % ($a>80$ atomic %), it is difficult to produce the amorphous structure. Unlike a structure formed by a crystalline intermetallic compound, the amorphous structure enables an enlargement of the range of temperature in which a high effective magnetic moment can be provided and also enables a wide selection of Curie points, and the like.

Al and Ga (A) act to stabilize the amorphous structure and to improve the wettability of a metal mold with a molten metal to accelerate the cooling. Therefore, Al and Ga (A) are elements which are essential for producing the amorphous structure for the magnetic refrigerant by a casting process. In adition, Al and the like functions to produce an extremely thin and firm oxide film that provides the magnetic refrigerant with a characteristic for restraining a loss or wear of the material due to oxidation by air so that it can be stored for a long period. If the content b of Al or Ga is less than 5 atomic % ($b<5$ atomic %), ultra-quenching means must be used for producing the amorphous structure. On the other hand, if the content b of Al or Ga is more than 50 atomic % ($b>50$ atomic %), the magnetization is significantly reduced.

Fe, Ni, Co, Cu and Ag (M) are essential elements for producing a magnetic refrigerant having an amorphous structure clearly exhibiting a glass transition temperature TM by co-addition along with Al or Ga.

The present invention utilizes the fact that the larger the difference ΔT between the glass transition temperature Tg and the crystallization temperature Tx for an amorphous alloy with the proviso that Tx>Tg, the lower the cooling rate of the molten metal can be and still produce an amorphous structure.

From *Materials Transaction*, JIM, Vol 31, No. 2 (1990), pp 104–109, it is known that if the difference ΔT between the glass transition temperature Tg and the crystallization temperature Tx is large, an amorphous alloy can be produced even at a slow cooling rate. Further, *Materials Transaction*, JIM, Vol 31, No. 5 (1990), pp 425–428, it is known that as the difference ΔT becomes larger, the thicker an amorphous alloy can be made by casting.

To effectively utilize the above facts, it is necessary to use an amorphous alloy which clearly shows a glass transition temperature Tg. If the content c of Fe or the like is less than 5 atomic % (c<5 atomic %), the above facts cannot be effectively utilized, and as a result, a thick magnetic refrigerant having an amorphous structure cannot be cast. On the other hand, If the content c of Fe or the like is more than 60 atomic % (c>60 atomic %), the magnetization is significantly reduced. It should be noted that unavoidable impurities in the magnetic refrigerant is of 1 atomic %.

The above-described difference ΔT is required to be at least 10 K. in order for the magnetic refrigerant to have excellent amorphous structure forming capability. The difference ΔT depends upon a correlation of individual chemical constituents Ln, A and M. However, Ln has a nature that it raises the glass transition temperature Tg and the crystallization temperature Tx; A has a nature that it lowers the glass transition temperature Tg and the crystallization temperature Tx; and M has a nature that it raises the glass transition temperature Tg and the crystallization temperature Tx. Therefore, in view of these natures, the contents of individual chemical constituents should be adjusted.

In producing a magnetic refrigerant having an amorphous structure, a process is employed which comprises ejecting a molten metal having the above-described composition and an amorphous alloy composition with a difference ΔT of 10 K. or more between the glass transition temperature Tg and the crystallization temperature Tx, onto an inner peripheral surface of a drum type rotary metal mold, and continuously solidifying the ejected molten metal at a cooling rate of $10^2$ K/sec or more.

This process enables a magnetic refrigerant as thick as 3 to 20 mm to be cast, because the alloy solidified on the inner peripheral surface of the rotary metal mold is accumulated thereon. In this case, the molten metal is solidified under a pressurized condition. This delays the crystallization of the molten metal and hence, is advatageous for producing the amorphous structure for the magnetic refrigerant.

The rotary metal mold is formed from a material having a good thermal conductivity, e.g., a Cu alloy or the like. The rotary metal mold need not be forcibly cooled. A cooling rate of $10^2$ K/sec or more is required for producing the amorphous structure. If a molten metal is cooled and solidified on an outer peripheral surface of a rotor, the cooling rate can be further increased, but in this method, a thick magnetic refrigerant cannot be produced.

A cylindrical magnetic refrigerant is produced by the above-described casting process. When this cylindrical magnetic refrigerant is to be placed into a container of the magnetic refrigerator, it may be subjected to a predetermined working as required. For example, when a magnetic refrigerant thicker than that produced by the casting process and having a predetermined size, the following procedure is employed: The magnetic refrigerant produced by the casting process is used as an intermediate product and is cut into a proper size and then subjected to a setting or rectifying treatment for removal of a warpage. The resulting flat plates are laminated and press-bonded, thereby providing a magnetic refrigerant having a proper thickenss and size and a density of 99% or more. The press-bonding is a hot working conducted at a temperature between a glass transition temperature Tg and a crystallization temperature Tx. This is for the purpose of increasing the workability by utilizing a phenomenon that a material having an amorphous structure becomes an ultraplastic when it is heated to its glass transition temperature Tg or higher. However, if the working temperature exceeds the crystallization tempetaure Tx, the worked material will crystallize. Therefore, the working temperature should be set at a value lower than the crystallization temperature Tx.

The magnetic refrigerant according to the present invention has the following effects: (a) it has a large magnetization and thus a high cooling efficiency, because it has been formed into a large-size block by use of the casting process; (b) it has a high coefficient of thermal conductivity, because there is little bore; (c) it has a uniform surface which is slow to oxidize, because it has an amorphous structure even if it contains a large amount of Ln added thereto; (d) it has a large electric resistance and thus its power loss due to eddy currents is small, because it is of amorphous alloy; and (e) it is easily formed into a large-sized block by a hot-working, because it has an excellent toughness and a large difference ΔT between the glass transition temperature Tg and the crystallization temperature Tx.

The above and other objects, features and advantages of the invention will become apparent from a consideration of the following description of the preferred embodiments, taken in conjunction with the accomapnying drawings.

DESCRIPTION OF THE PREFERRED EMBODIMENTS

EXAMPLE 1

Figure 1:
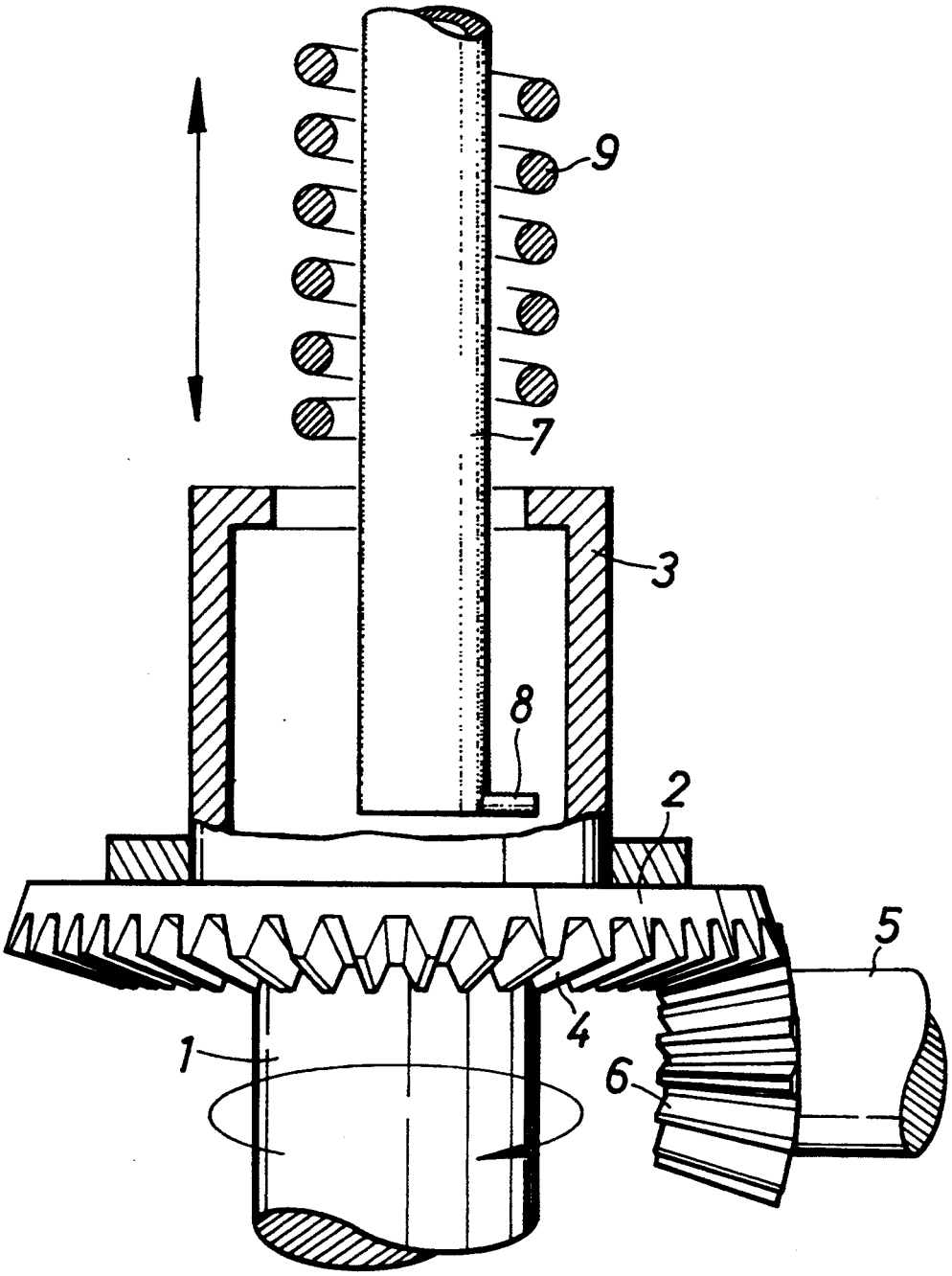
FIG. 1 is a view of a casting apparatus.

FIG. 1 illustrates a casting apparatus for producing a magnetic refrigerant or magnetic refrigeration working substance. The apparatus is constructed in the following manner:

A bevel gear type supporting plate 2 is horizontally mounted on an upper end of a vertical rotary shaft 1, and a drum-like rotary metal mold 3 made of a Cu alloy is mounted on an upper surface of the supporting plate 2. A bevel gear 6 of a driving shaft 5 connected to a motor or the like is meshed with a toothed portion 4 of an outer peripheral surface of the supporting plate 2. A crucible 7 of quartz is inserted into the rotary metal mold 3, and is provided at a leading end of the crucible with a nozzle 8 which is opposed to a lower portion of an inner peripheral surface of the rotary metal mold 3. The crucible 7 is liftable, and a heater 9 having a high-frequency induction coil is disposed around an outer periphery of the crucible 7 outside the rotary metal mold 3.

First, an ingot having an amorphous alloy composition represented by $Gd_{50}Al_{20}Cu_{30}$ (wherein each of numeral values is an atomic %) was produced using an arc furnace. Then, the ingot was placed into the crucible 7 and heated by heater 9 to prepare a molten metal, and the rotary metal mold 3 was rotated at a peripheral speed of 10 to 40 m/sec. The crucible 7 was raised while ejecting the molten metal through the nozzle 8 of the crucible 7 onto the inner peripheral surface of the rotary metal mold 3. In this case, the amount of molten metal ejected was set such that the thickness of the solidified alloy became 50 μm or less upon one rotation of the rotary metal mold. The cooling rate for the molten metal was set at $10^2$ K/sec.

A cylindrical magnetic refrigerant having an outside diameter of 50 mm, a thickness of 3 mm and a length of 10 mm was produced through the above-described steps.

A test piece fabricated from the magnetic refrigerant was subjected to X-ray diffraction, thereby examining the metallographic structure of the magnetic refrigerant. As a result, it was confirmed that the metallographic structure was an amorphous structure.

The test piece was also subjected to various measurements, thereby providing the following results:

| | |
|---|---|
| Glass transition temperature Tg | 536 K. |
| Crystallization temperature Tx | 575 K. |
| Difference ΔT between the temperatures Tx and Tg | 39 K. |
| Curie temperature Tc | 68 K. |
| Magnetic moment | 7.9 μB |
| Close-contact bending test | Close-contact bendable at 180° |
| Oxidation resistance | No oxidation increment |

The measurements of the glass transition temperature Tg and the crystallization temperature Tx were conducted by a differential scanning calorimeter (DSC). The Curie temperature Tc and the magnetic moment were calculated by VSM. The close-contact bending test was conducted by bending the test piece while bringing it into close contact with an outer peripheral surface of a round rod having a diameter of 0.3 mm. In the oxidation resistance test, the test piece was heated in the atmosphere at 100° C. for 1 hour, and the weights of the test piece before and after the heating thereof were compared with each other to estimate the degree of oxidation.

The following experiment was carried out in order to examine whether or not the magnetic refrigerant produced by the above-described casting process had physical properties equivalent to those of a ribbon produced by a single-roll process and having an amorphous structure.

Figure 2:
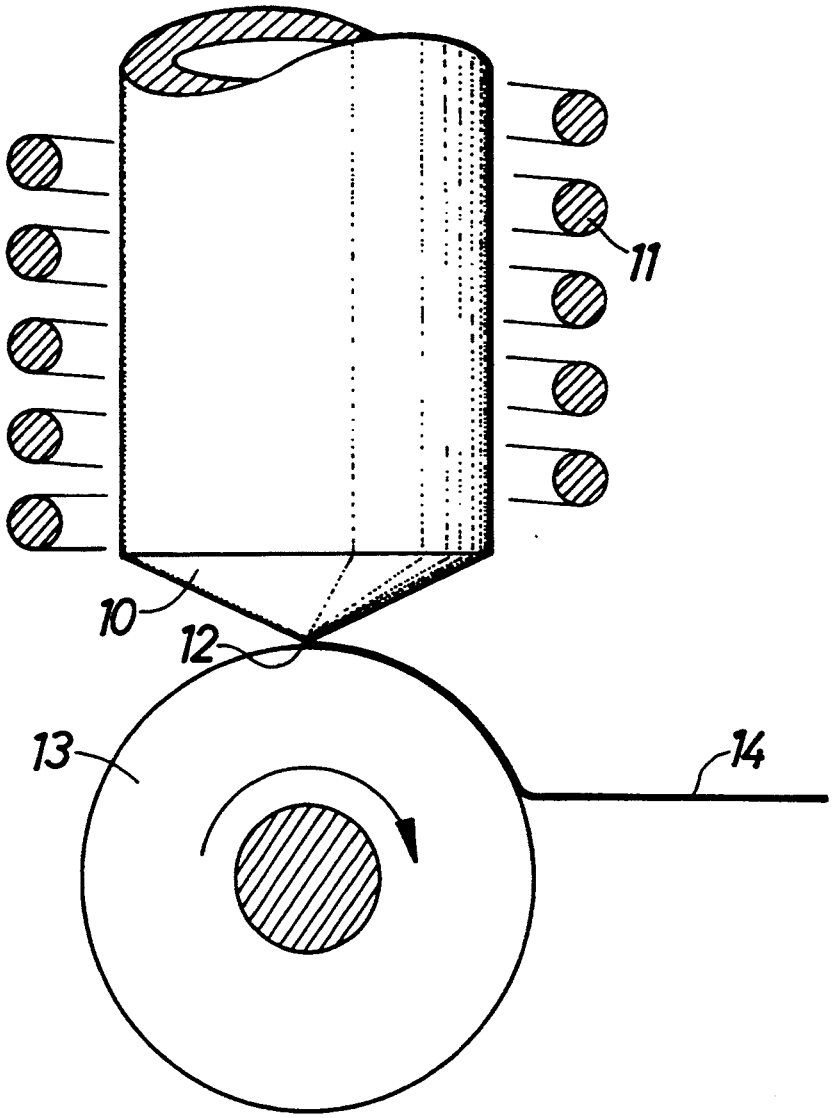
FIG.2 PRIOR ART
FIG. 2 is a view of a single-roll apparatus.

An ingot having the same composition as the above-described composition was placed into a quartz crucible 10 of a single-roll apparatus shown in FIG. 2. Atmosphere in the crucible 10 was evacuated to a high vacuum and then the crucible 10 was filled with argon gas to produce an argon gas atmosphere. Then, the ingot was heated by a heater 11 having a high-frequency induction coil which is disposed around an outer periphery of the crucible 10, thereby preparing a molten metal. Thereafter, the molten metal was ejected through a nozzle 12 having a diameter of 0.3 mm and located in a bottom wall of the crucible 10 onto an outer peripheral surface of a roll 13 of a Cu alloy rotating at a peripheral speed of 15 m/sec and was quenched and solidified, thereby providing a ribbon 14 having a thickness of 10 μm, a width of 1 mm and a length of 5 mm.

A test piece fabricated from the ribbon was subjected to an X-ray diffraction to examine the metallographic structure. As a result, it was confirmed that the metallographic structure was an amorphous structure.

The test piece was likewise subjected to various measurements to give the following results:

| | |
|---|---|
| Glass transition temperature Tg | 535 K. |
| Crystallization temperature Tx | 573 K. |
| Difference ΔT between the temperatures Tx and Tg | 38 K. |
| Curie temperature Tc | 67 K. |
| Magnetic moment | 8 μB |
| Close-contact bending test | Close-contact bendable at 180° |
| Oxidation resistance | No oxidation increment |

It was confirmed from the above results that the magnetic refrigerant having substantially the same physical properties as those produced by the single-roll process could be produced even by the casting process.

EXAMPLE 2

Using the casting apparatus shown in FIG. 1, a cylindrical magnetic refrigerant having the above described various compositions and an outside diameter 50 mm, a thickness of 2 mm and a length of 10 mm was produced in the same manner as in Example 1.

The relationship among the compositions, metallographic structures, differences ΔT between the crystallization temperature Tx and glass transition temperature Tg, and Curie temperatures are as given in Tables I to III. In each Table, amo means an amorphous structure, and cry means a crystalline structure.

TABLE 1

| Magnetic referigerant No. | Chemical constituent (atomic %) Ln Gd | A Al | M Cu | Metallographic structure | ΔT (K.) | Tc (K.) |
|---|---|---|---|---|---|---|
| (1) | 50 | 30 | 20 | amo | 62 | 70 |
| (2) | 50 | 40 | 10 | amo | 24 | 68 |
| (3) | 70 | 20 | 10 | amo | 18 | 72 |
| (4) | 60 | 10 | 30 | amo | 33 | 60 |
| (5) | 40 | 20 | 40 | amo | 21 | 38 |
| (6) | 30 | 30 | 40 | amo | 18 | 37 |
| (7) | 60 | 40 | — | cry | <5 | 68 |
| (8) | 70 | — | 30 | cry | <5 | 70 |
| (9) | 10 | 45 | 45 | cry | <5 | 82 |
| (10) | 15 | 80 | 5 | cry | <5 | 35 |

TABLE II

| Magnetic referigerant No. | Chemical constituent (atomic %) Ln | A Ga | M Fe | Co | Ni | Cu | Ag | Metallographic structure | ΔT (K.) |
|---|---|---|---|---|---|---|---|---|---|
| (11) | Ce 50 | 30 | — | — | 20 | — | — | amo | 31 |
| (12) | Pr 50 | 30 | — | 10 | 10 | — | — | amo | 52 |
| (13) | Nd 50 | 30 | — | — | 10 | 10 | — | amo | 36 |
| (14) | Sm 50 | 30 | — | — | — | — | 20 | amo | 28 |
| (15) | Eu 50 | 30 | 5 | — | 15 | — | — | amo | 32 |

TABLE III

| Magnetic referigerant No. | Chemical constituent (atomic %) Ln | A Al | M Cu | Metallographic structure | ΔT (K.) | Tc (K.) |
|---|---|---|---|---|---|---|
| (16) | Tb 50 | 30 | 20 | amo | 28 | — |
| (17) | Dy 50 | 30 | 20 | amo | 24 | 52 |
| (18) | Ho 50 | 30 | 20 | amo | 32 | — |
| (19) | Er 50 | 30 | 20 | amo | 35 | — |
| (20) | Tm 50 | 30 | 20 | amo | 42 | — |
| (21) | Yb 50 | 30 | 20 | amo | 38 | — |

Figure 3:
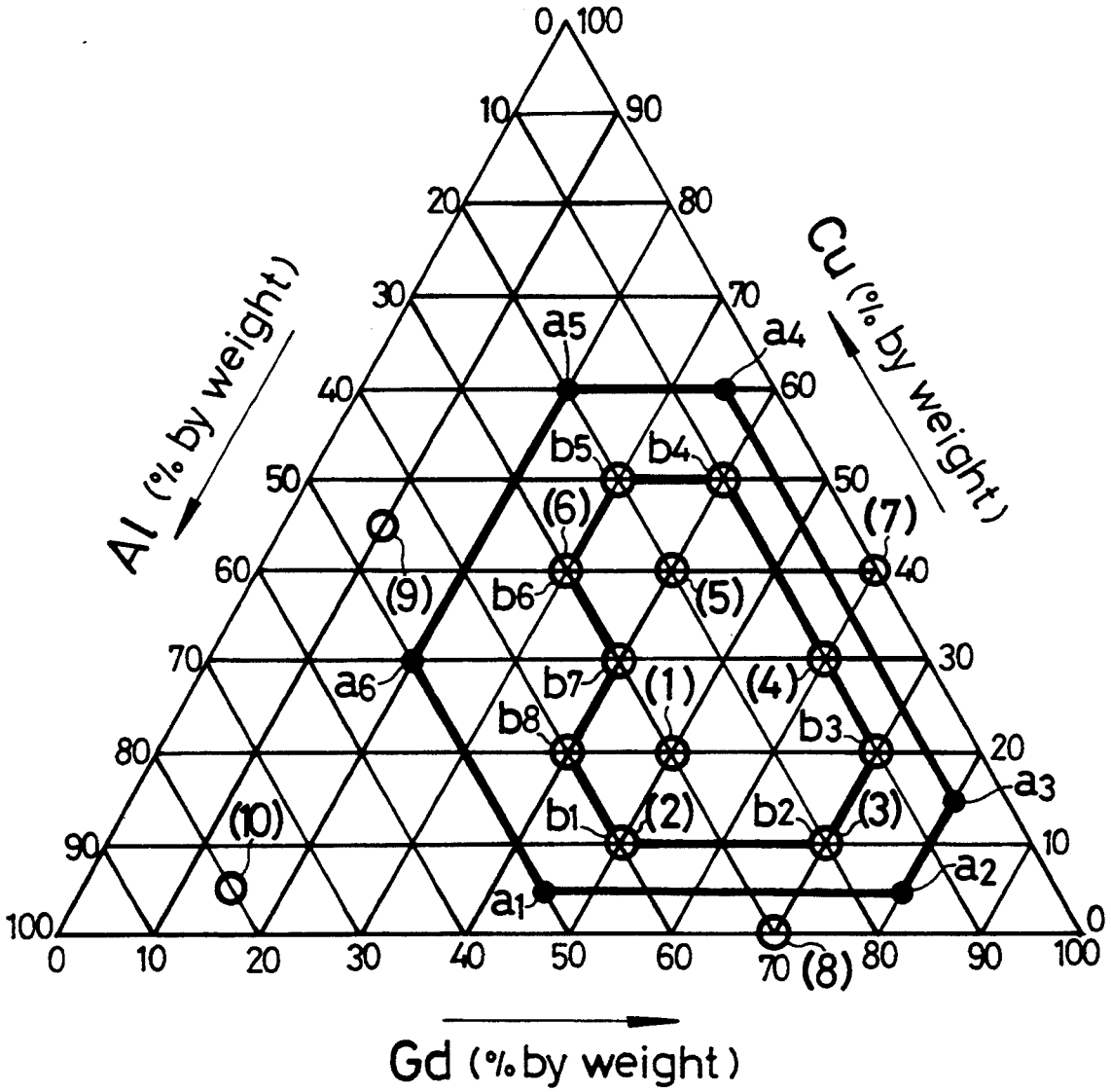
FIG. 3 is a diagrgam of composition for Gd-Al-Cu based magnetic refrigerants.

FIG. 3 is a diagram of composition for Gd-Al-Cu based magnetic refrigerants. In FIG. 3, individual points (1) to (10) correspond to the magnetic refrigerants Nos. (1) to (10) given in Table I, respectively. The extent of composition in the present invention is a region surrounded by points a1 to a6, and a preferable extent of composition is a region surrounded by points b1 to b6.

As apparent from Tables I to III and FIG. 3, if Ln such as Gd, A such as Al and M such as Cu satisfy the above-described extent and ΔT is at least 10 K., a magnetic refrigerant having an amorphous structure can be produced.

EXAMPLE 3

First, an ingot having an amorphous alloy composition represented by $Dy_{50}Al_{35}Ni_{15}$ (wherein each of numeral values is atomic %) was produced using an arc furnace. Then, the ingot was pulverized to provide a powder. Twenty-five (25) grams of this powder was placed into the crucible 7 of the casting apparatus shown in FIG. 1 and heated by the heater 9 to prepare a molten metal, and the rotary metal mold 3 was rotated at a peripheral speed of 30 m/sec. The crucible 7 was raised while ejecting the molten metal through the nozzle 8 of the crucible 7 onto the inner peripheral surface of the rotary metal mold 3. In this case, the amount of molten metal ejected was set such that the thickness of the solidified alloy became 50 μm or less upon one rotation of the rotary metal mold 3. And the cooling rate for the molten metal was set at $10^2$ K/sec.

A cylindrical magnetic refrigerant having an outside diameter of50 mm, a thickness of 3 mm and a length of 10 mm was produced through the above-described steps.

A test piece fabricated from this magnetic refrigerant was subjected to X-ray diffraction, thereby examining the metallographic structure of the magnetic refrigerant. As a result, it was confirmed that the metallographic structure was an amorphous structure.

The test piece was subjected to differential scanning calorimeter (DSC) testing to determine the alloy's glass transition temperature Tg and crystallization temperature Tx. The results showed that the glass transition temperature Tg was of 520 K., while the crystallization temperature Tx was of 572 K., and a difference ΔT between both the temperatures was of 52 K.

The temperature dependence of a magnetic entropy ($\Delta S_M$) was measured for the test piece, and the results showed that a temperature at which a maximum magnetic entropy was shown by magnetization at 3 T (tesla) to 6 T was of 40 K. It was ascertained from this that the magnetic refrigerant produced by the casting process was effective and suitable as a magnetic refrigerant for use in a high temperature region.

Then, a curved plate was cut from the cylindrical magnetic refrigerant and subjected to a hot press at a glass transition temperature Tg plus 10 K., i.e., at a tempetaure of 530 K., to provide a flat plate. A test piece as an example of the present invention and having a diameter of 10 mm and a length of 2 mm was made from this flat plate, and the coefficient of thermal conductivity was measured for this test piece.

For comparison, a molten metal of the same composition as that described above was used to produce a ribbon having a thickness of 40 μm and a width of 15 mm by the single-roll apparatus shown in FIG. 2. This ribbon had an amorphous structure, and a glass transition temperature Tg and a crystallization temperature Tx thereof that were substantially equal to those of the magnetic refrigerant produced by the above-described casting process.

Then, a thin plate having a length of 30 mm was cut from the ribbon. A hundred sheets of the thin plates were laminated one on another, and the resulting laminate was subjected to a hot press at a temperature of glass transition temperature Tg plus 10 K. to provide a flat plate having a density of 99%. A test piece as a comparative example having a diameter of 10 mm and a length of 2 mm was made from the flat plate, and the coefficient of thermal conductivity was measured for this test piece.

Figure 4:
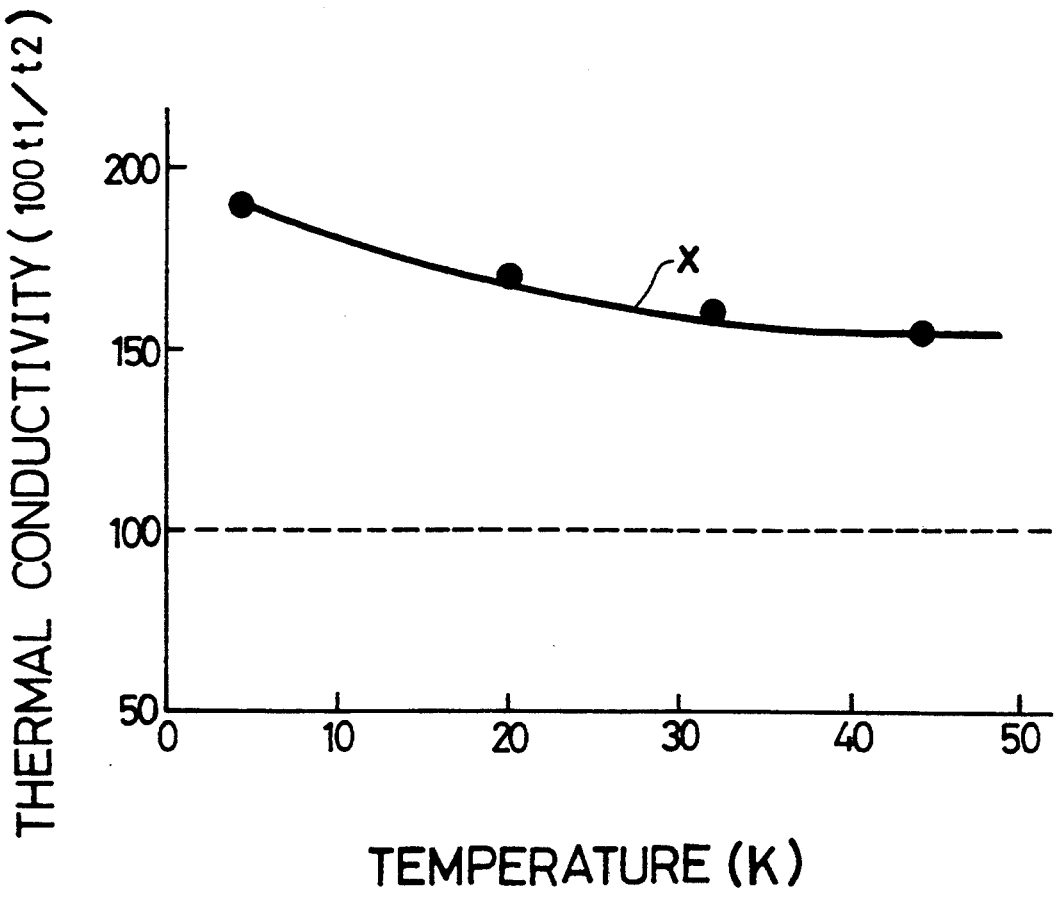
FIG. 4 is a graph illustrating a relationship between the temperature and the coefficient of thermal conductivity.

FIG. 4 illustrates a relationship between the temperature and the coefficient of thermal conductivity for the test piece as the example of the present invention. In FIG. 4, a line x represents a rate value corresponding to a coefficient of thermal conductivity t1 of the test piece as the example of the present invention when the coefficient of thermal conductivity t2 of the test piece as the comparative example is 100, i.e., 100t1/t2.

As apparent from the line x in FIG. 4, the coefficient of thermal conductivity of the test piece as the example of the present invention is higher than that of the test piece as the comparative example, thereby ensuring that the magnetic refrigerant produced by the casting process enables an operation in a high cycle.

Moreover, an oxygen analysis was carried out for both the test pieces, and the results showed that the amount of oxygen was of 1.0 ppm in the test piece as the example of the present invention, and of 14.1 ppm in the test piece as the comparative example. It was ascertained that the amount of oxygen in the test piece as the comparative example was extremely larger than that in the test piece as the example of the present invention because of an oxide film on the surface of the ribbon, and this oxide film prevented an increase in coefficient of thermal conductivity.

For example, when a magnetic refrigerant thicker than a cylindrical magnetic refrigerant and shaped into a flat plate is required, a procedure is employed which comprises laminating a plurality of single-layer plates cut from the cylindrical magnetic refrigerant, and subjecting the resulting laminate to a hot press.

In this case, the specific surface area of each single-layer plate is very small as compared with that of the plate cut from the ribbon produced by the single-roll process, and, therefore, in the hot press step, particularly, it is-possible to generate an active plastic flow in a surface region of the single-layer plate and to increase the working ratio. This makes it possible to sufficiently destruct the oxide film on each of single-layer plates to avoid a reduction in coefficient of thermal conductivity due to the surface oxide film to the utmost.

EXAMPLE 4

First, an ingot having an amorphous alloy composition represented by $Gd_{60}Al_{20}Cu_{20}$ (wherein each of numeral values is an atomic %) was produced by a vacuum melting process. Then, the ingot was placed into the crucible 7 of the casting apparatus shown in FIG. 1 and heated by the heater 9 to prepare a molten metal, and the rotary metal mold 3 was rotated at a peripheral speed of 30 m/sec. The crucible 7 was raised while ejecting the molten metal through the nozzle 8 of the crucible 7 onto the inner peripheral surface of the rotary metal mold 3. In this case, the amount of molten metal ejected was set such that the thickness of the solidified alloy became 50 μm or less upon one rotation of the rotary metal mold, and a cooling rate for the molten metal was set at $10^2$ K/sec.

A cylindrical magnetic refrigerant having an outside diameter of 50 mm, a thickness of 3 mm and a length of 10 mm was produced through the above-described steps.

A test piece fabricated from this magnetic refrigerant was subjected to X-ray diffraction, thereby examining the metallographic structure of the magnetic refrigerant. As a result, it was confirmed that the metallographic structure was an amorphous structure.

In addition, the test piece was subjected to a differential scanning calorimeter (DSC) to measure a glass transition temperature Tg and a crystallization Tx, and as a result, it was confirmed that the glass transition temperature Tg was of 535K, while the crystallization Tx was of 573 K., and a difference ΔT between both the temperatures was of 38K.

For comparison, a ribbon having the same composition as that described above was produced by a single-roll process, and a plurality of thin plates cut from the ribbon were laminated and subjected to a hot press to produce a thick plate. And a test piece as a comparative example was made from the thick plate.

Figure 5:
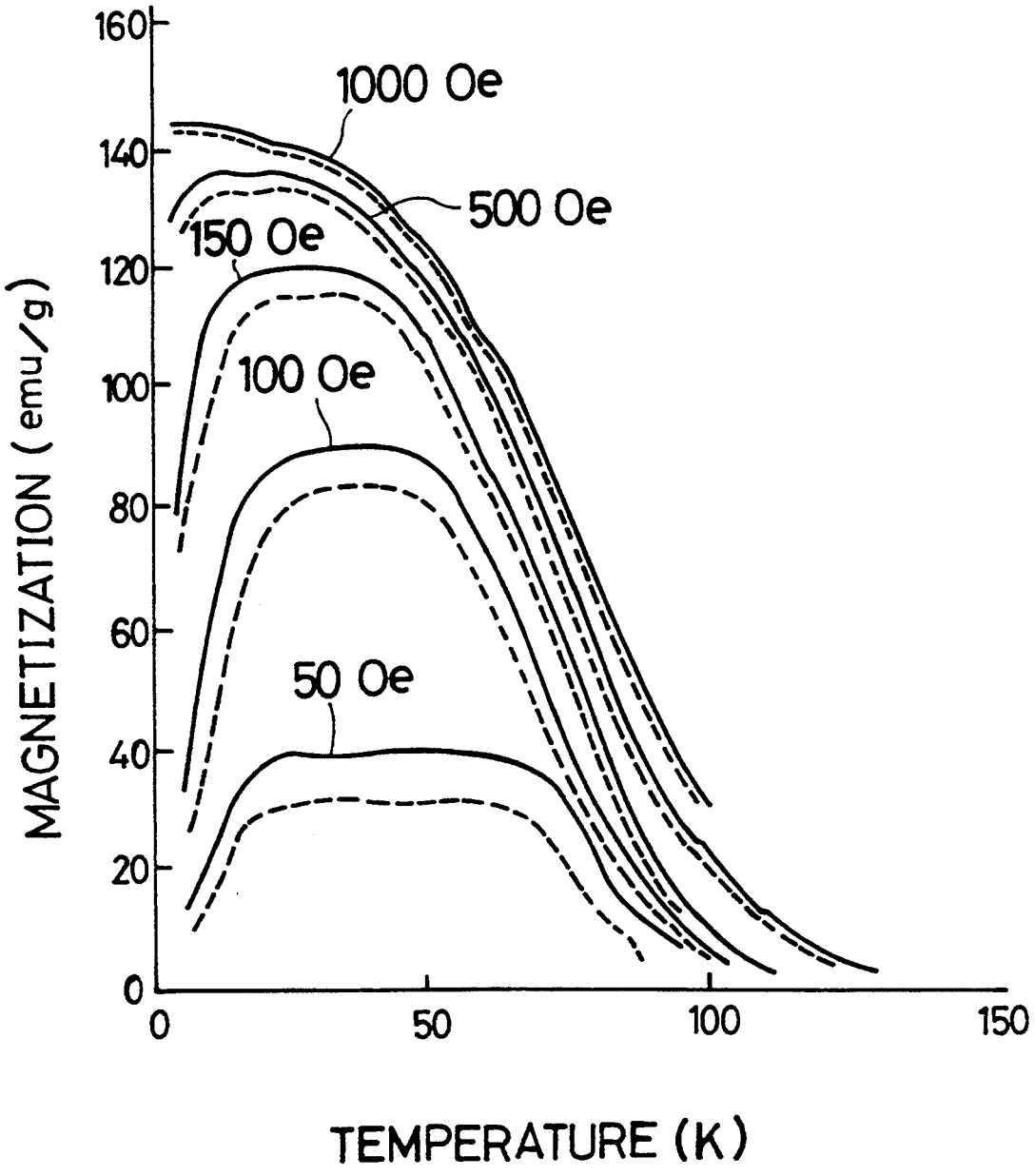
FIG. 5 is a graph illustrating a relationship between the temperature and the magnetization.

The magnetization at different intensities of external magnetic field and at different temperatures was measured for the test piece as the example of the present invention, which were made from the cylindrical magnetic refrigerant, and the test piece as the comparative example, thereby providing results shown in FIG. 5, wherein solid lines correspond to the results for the test pieces as the example of the present invention, and dotted lines correspond to the results for the test pieces as the comparative example.

As is apparent from FIG. 5, the magnetization of the test piece as the example of the present invention is intenser than that of the test piece as the comparative example at the same intensity of external magnetic field and at the same temperature. It can be seen from this that the test piece as the example of the present invention has an excellent effect as a magnetic refrigerant.

Two of the curved plates obtained by axially quatering the cylindrical magnetic refrigerant were put one on another and subjected to a hot press under conditions of a working temperature of 550±20 K. and a pressing force of 1,000 Kg/cm$^2$, thereby providing a thick plate-like magnetic refrigerant having a thickness of 5 mm.

This magnetic refrigerant had a density of 99.9%, and had no cracks generated due to the hot press.

What is claimed is:

1. A magnetic refrigerant, which has a composition represented by $$Ln_aGa_bM_c$$

wherein Ln is at least one element selected from the group consisting of Ce, Pr, Nd, Sm, Eu, Gd, Tb, Dy, Ho, Er, Tm and Yb; M is at least one element selected from the group consisting of Fe, Co, Ni, Cu and Ag; and each of a, b and c are atomic percentages, with the proviso that $a+b+c=100$ atomic %, 20 atomic % $\leqq a \leqq 80$ atomic %, 5 atomic % $\leqq b \leqq 50$ atomic %, 5 atomic % $\leqq c \leqq 60$ atomic %, and wherein said magnetic refrigerant has an amorphous structure with a difference ΔT of 10K or more between a glass transition temperature Tg and a crystallization temperature Tx, with the proviso that $Tx > Tg$.

* * * * *